US011735151B2

(12) United States Patent
McCormick

(10) Patent No.: US 11,735,151 B2
(45) Date of Patent: Aug. 22, 2023

(54) ELECTRIC GUITAR PICKUP SELECTOR SWITCH POSITION LOCK

(71) Applicant: Lance Robert McCormick, Chatsworth, CA (US)

(72) Inventor: Lance Robert McCormick, Chatsworth, CA (US)

(73) Assignee: Lance R. McCormick, Chatsworth, CA (US)

( * ) Notice: Subject to any disclaimer, the term of this patent is extended or adjusted under 35 U.S.C. 154(b) by 139 days.

(21) Appl. No.: 17/105,589

(22) Filed: Nov. 26, 2020

(65) Prior Publication Data

US 2022/0165240 A1 May 26, 2022

(51) Int. Cl.
*G10H 3/18* (2006.01)

(52) U.S. Cl.
CPC ..... *G10H 3/183* (2013.01); *G10H 3/181* (2013.01)

(58) Field of Classification Search
CPC ..... G10H 3/183; G10H 3/181
USPC ..... 84/726
See application file for complete search history.

(56) References Cited

U.S. PATENT DOCUMENTS 2,817,261 A 12/1957 Fender
2,968,204 A 1/1961 Fender
3,294,677 A 5/1966 Burns
3,290,424 A 12/1966 Fender
3,472,943 A 10/1969 Kawabata
5,012,716 A * 5/1991 Pagelli ..... G10H 3/182 84/727
5,311,806 A 5/1994 Riboloff
6,781,050 B2 8/2004 Olvera
7,208,673 B2 * 4/2007 Bryce ..... H01H 25/00 84/742
7,999,171 B1 * 8/2011 Hamilton ..... G10H 3/182 84/727
8,283,552 B2 10/2012 Ekstrom
8,288,636 B1 * 10/2012 Rahn ..... G10D 1/085 84/297 S
11,289,061 B2 * 3/2022 Conway, Jr. ..... G10H 3/186
2005/0040022 A1 * 2/2005 Turner ..... G10H 3/182 200/538
2005/0087063 A1 * 4/2005 Bryce ..... G10H 3/182 84/742
2011/0290099 A1 * 12/2011 Franklin ..... G10H 3/182 84/723
2012/0036983 A1 * 2/2012 Ambrosino ..... G10H 3/06 84/731
2014/0041514 A1 * 2/2014 Gross ..... G10H 3/181 84/726
2014/0298974 A1 * 10/2014 Kawahashi ..... H03G 5/02 84/622
2016/0049142 A1 * 2/2016 Radmacher ..... G10H 3/181 84/726
2021/0358463 A1 * 11/2021 Misko ..... G10H 1/0008
2022/0157287 A1 * 5/2022 Brancalion ..... G10H 3/143
2022/0165240 A1 * 5/2022 McCormick ..... G10H 3/183
2023/0032630 A1 * 2/2023 Ailes ..... G10H 1/46

FOREIGN PATENT DOCUMENTS

WO WO-9614649 A1 * 5/1996 ..... H01H 31/00

* cited by examiner

*Primary Examiner* — Christina M Schreiber

(57) ABSTRACT

Mechanical methods for temporarily securing or stopping the pickup selector switch of an electronically amplified string musical instrument with multiple electromagnetic pickups.

6 Claims, 8 Drawing Sheets

ELECTRIC GUITAR PICKUP SELECTOR SWITCH POSITION LOCK

FEDERALLY SPONSORED RESEARCH

Not Applicable

SEQUENCE LISTING OF PROGRAM

Not Applicable

FIELD OF INVENTION

This invention is for electric guitars that have multi pickup arrangements activated individually or collectively by a multi position selector switch located on face of guitar, that consist of a body, neck, and plurality of strings under tension.

BACKGROUND OF INVENTION

The core elements of the modern solid body guitar appeared in the mid 1950's, with the development and rise in popularity of the multi electromagnetic pickup models; a necessity arose for pickups to have a method of "on and off" switching. The Fender, Stratocaster, introduced in 1954, made the three pickup solid body guitar arrangement one of the most popular set ups. The instrument used a 5-way blade style pickup selector switch that has become the industry standard, in which the first position activates the neck pickup, second position; the neck and middle pickups, third position the middle pickup, fourth position the middle and bridge pickups, and fifth position the bridge pickup alone.

These blade pickup selectors move very easy and are designed to facilitate changes in pickup combinations with a very light touch during a performance. It became common for guitar players to use different pickup combinations in different sections of the same composition, as a way of enhancing orchestration and sophistication of the guitar's contribution to performance.

The easy of pickup selector movement is a great tool for tailoring instrument tone to sections of a song but it can also presents some minor draw backs. As it became a common practice to perform many rhythm guitar parts utilizing the neck pickup only, which places the pickup selector switch in the most forward position, the position closest to the performers strumming hand. Through discussions with many guitar players it became clear that there was a need for a product that could lock the pickup selector switch in one position in certain instances, as in, if the front pickup was desired for a songs entirety and said song required a very active strumming pattern, in such situation many guitarist inadvertently knocking the pickup selector switch out of position; which can have a distracting and negative effect on performance. Therefore the development of an Electric Guitar Selector Switch Position Lock was needed. Through the creation and addition of a mechanical method; by which the existing blade selector switch can be temporary secured in position; to prevent the inadvertent changing of electromagnetic pickup switch selector; during a performance while artist is actively strumming instrument, the solid body electric guitar's electronic performance controls are improved.

SUMMARY OF INVENTION

Therefore it is the intention of this invention to introduce a number of mechanical methods by which an electric guitar pickup selector switch can be temporarily secured in one position. This invention was realized by the common place; inadvertent; dislodging of the electric guitar pickup selector switch while performer actively strums instrument; when said selector switch is located in one of the first four positions. With the introduction of a mechanical stopping mechanism that can temporarily lock the pickup selector switch in one of the available positions desired by performer; the electronic controls of the electric guitar are made more stable and have greater consistency; in regards to sound tailoring options provided by electromagnetic pickup selections; regardless of the activity presented to the area in proximity of said pickup selector switch via performers strumming appendage.

In the creation of a retro fit base plate that employs the same fastener points of existing guitar pickup selector switch; a sliding, latching, ratcheting, fastening, twist locking, temporary securing devise can be attached to said base plate and positioned behind pickup selector switch cap; preventing inadvertent movement of pickup selector switch from the passage of downward and upward strokes across guitar strings and electromagnetic pickups by performers hand.

BRIEF DESCRIPTION OF THE SEVERAL VIEWS OF THE DRAWINGS

FIG. 8 is an enlarged view of a selector switch position lock apparatus depicted in FIG. 5 containing additional features Other object, features, and advantages will occur from the following description of the preferred embodiment and the accompanying drawings, in which:

FIG. 1 illustrates a face view of a solid body electric guitar with three electromagnetic pickups, indicating a method of fabrication for Electric Guitar Pickup Selector Switch Position Lock; in which the three component parts are represented; base plate is 1, selector switch lock retaining post 3, and switch lock retaining post adjustment knob 4, with pickup selector switch 2, FIG. 2 is an exploded view indicating the FIG. 1 fabrication method for the Electric Guitar Pickup Selector Switch Position Lock in which the base plate is 1, the selector switch retaining post is 3, and the switch lock retaining post adjustment knob is 2, adjustment track 13, mounting hole 8.

FIG. 3 illustrates a face view of a solid body electric guitar with three electromagnetic pickups, indicating a second fabrication method for the Electric Guitar Pickup Selector Switch Position Lock in which base plate is 1, selector switch lock swing arm retaining plate 3, and switch lock retaining post adjustment knob 4, and pickup selector switch is 2.

FIG. 4 is an exploded view indicating the FIG. 3 fabrication method for the Electric Guitar Pickup Selector Switch Position Lock in which the base plate is illustrated by 1, mounting screw holes 8, adjustment and securing knob threaded mounting hole 7, the selector switch swing arm retaining plate 3, mounting hole 6, switch lock retaining post adjustment and securing knob 2.

FIG. 5 illustrates a face view of a solid body electric guitar with three electromagnetic pickups, indicating a third fabrication method for the Electric Guitar Pickup Selector Switch Position Lock in which the base plate is 1, selector switch lock retaining post 3, switch lock retaining post adjustment knob 4, retaining post and adjustment knob slot 11, and pickup selector switch is 2.

FIG. 6 is an exploded view indicating the FIG. 5 fabrication method for the Electric Guitar Pickup Selector Switch Position Lock in which the base plate is illustrated by 1, mounting screw holes 8, pickup selector switch slot 12, the selector switch slide retaining plate 3, selector switch slide retaining plate mounting hole 6, selector switch slide retaining plate adjustment slot 13, slide retaining plate adjustment and securing knob 2, slide retaining plate adjustment and securing knob adjustment slot 11.

FIG. 7 is an enhanced version of the FIG. 3/FIG. 4 fabrication method via the addition of corresponding pickup selector switch divot locations that can be added to top of base plate 1, or to bottom of selector switch swing arm retaining plate 3, in conjunction with set screw 9, or ball bearing 10, this design addition assists in locating the locking positions and enhances the security of position for the Electric Guitar Pickup Selector Switch Position Lock in which the base plate is illustrated by 1, threaded hole 7, for switch lock retaining post adjustment and securing knob 2, mounting screw holes 8, the selector switch swing arm retaining plate 3, selector switch swing arm retaining plate mounting hole 6, hole 5, for set screw 9, or ball bearing 10, employed as location finder for locking position divots 4.

FIG. 8 is an enhanced version of the FIG. 5/FIG. 6 fabrication method via the addition of corresponding pickup selector switch locking locations in slot 11, the combination of the switch lock slide retaining post adjustment and securing knob 2, which secures to twist lock neck block 14, into selector switch slide retaining plate mounting treaded hole 6, of selector switch slide retaining plate 3, allowing the Electric Guitar Pickup Selector Switch Position Lock to secure the pickup selector switch which is located and travels via slot 12, the additional elements are base plate 1, mounting screw holes 8, selector switch slide retaining plate adjustment slot 13.

Figure 1:
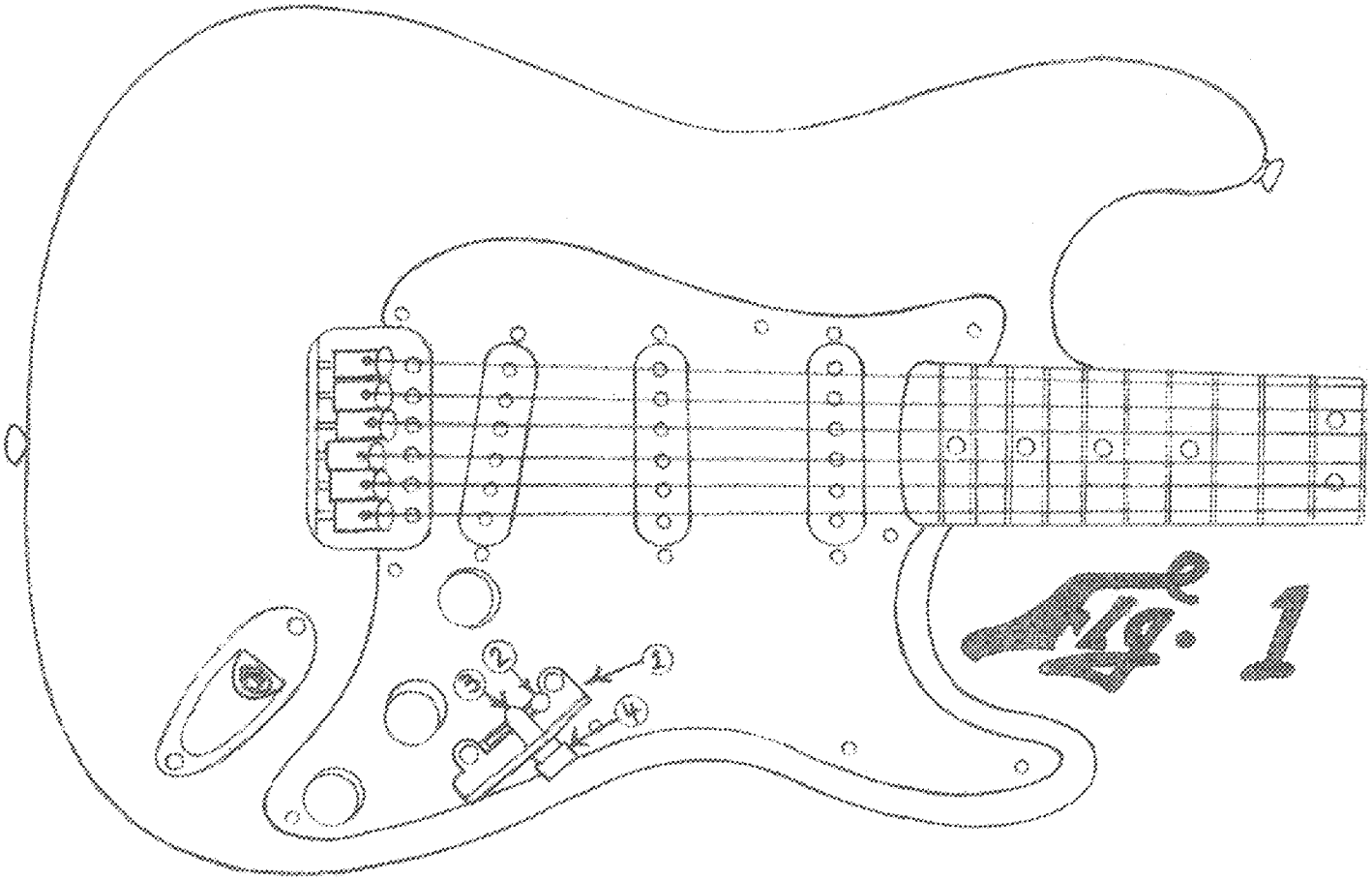
FIG. 1 is a view of a guitar having a selector switch position lock apparatus installed in congruence with present disclosure.
Figure 2:
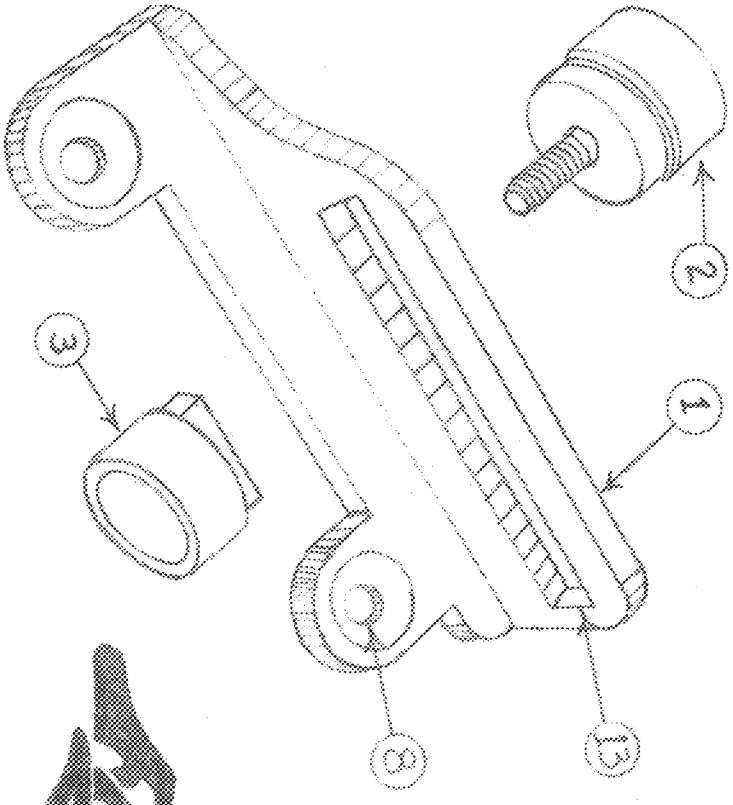
FIG. 2 is an enlarged view of a selector switch position lock apparatus depicted in FIG. 1.
Figure 3:
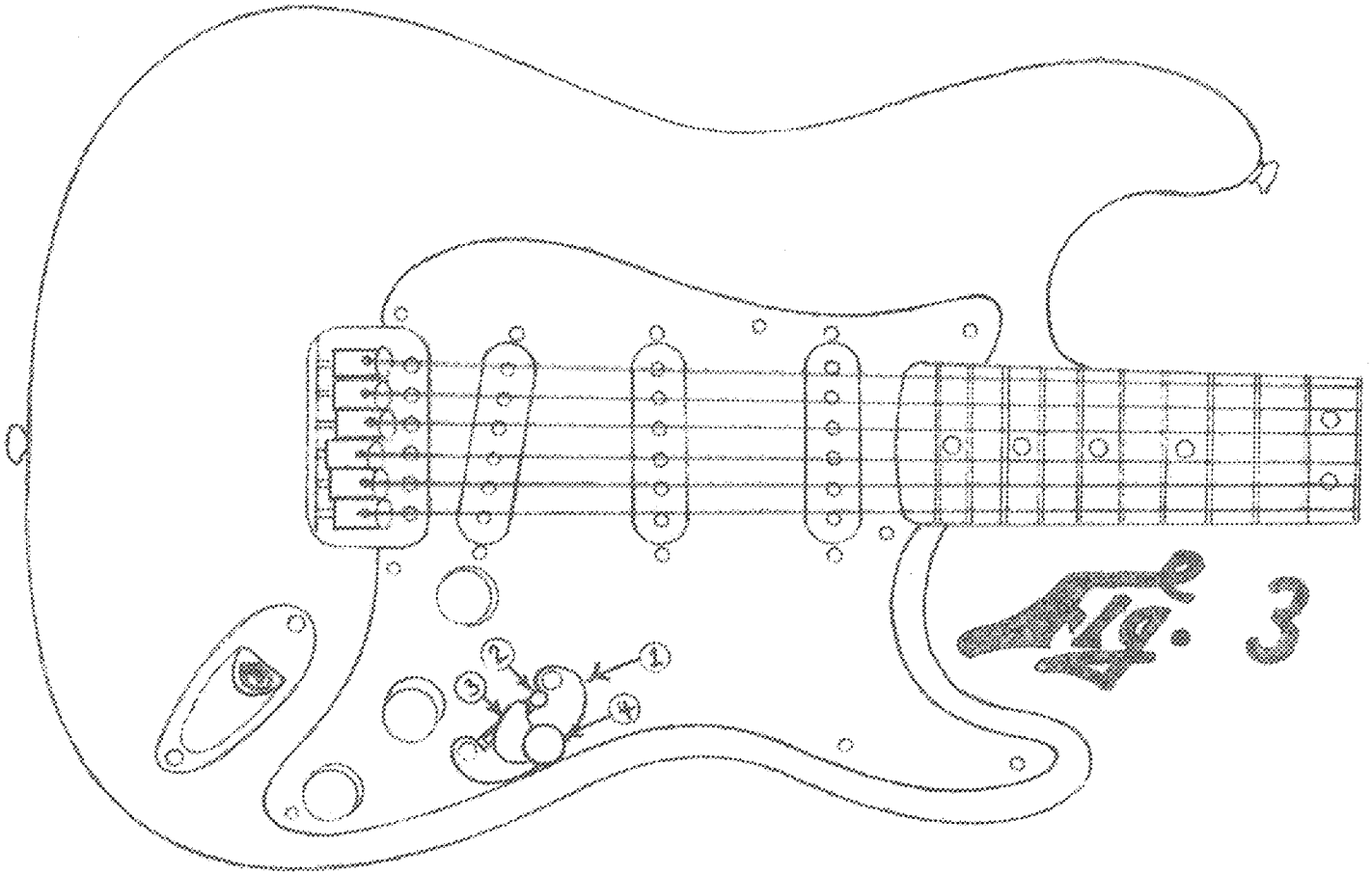
FIG. 3 is a view of a guitar having a selector switch position lock apparatus installed in congruence with present disclosure.
Figure 4:
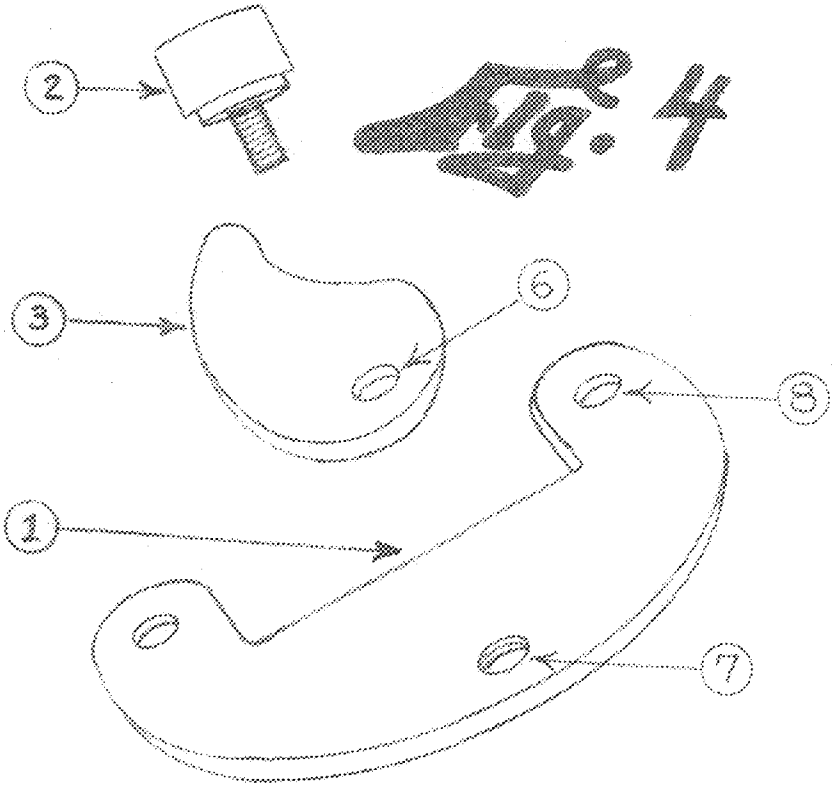
FIG. 4 is an enlarged view of a selector switch position lock apparatus depicter in FIG. 3.
Figure 5:
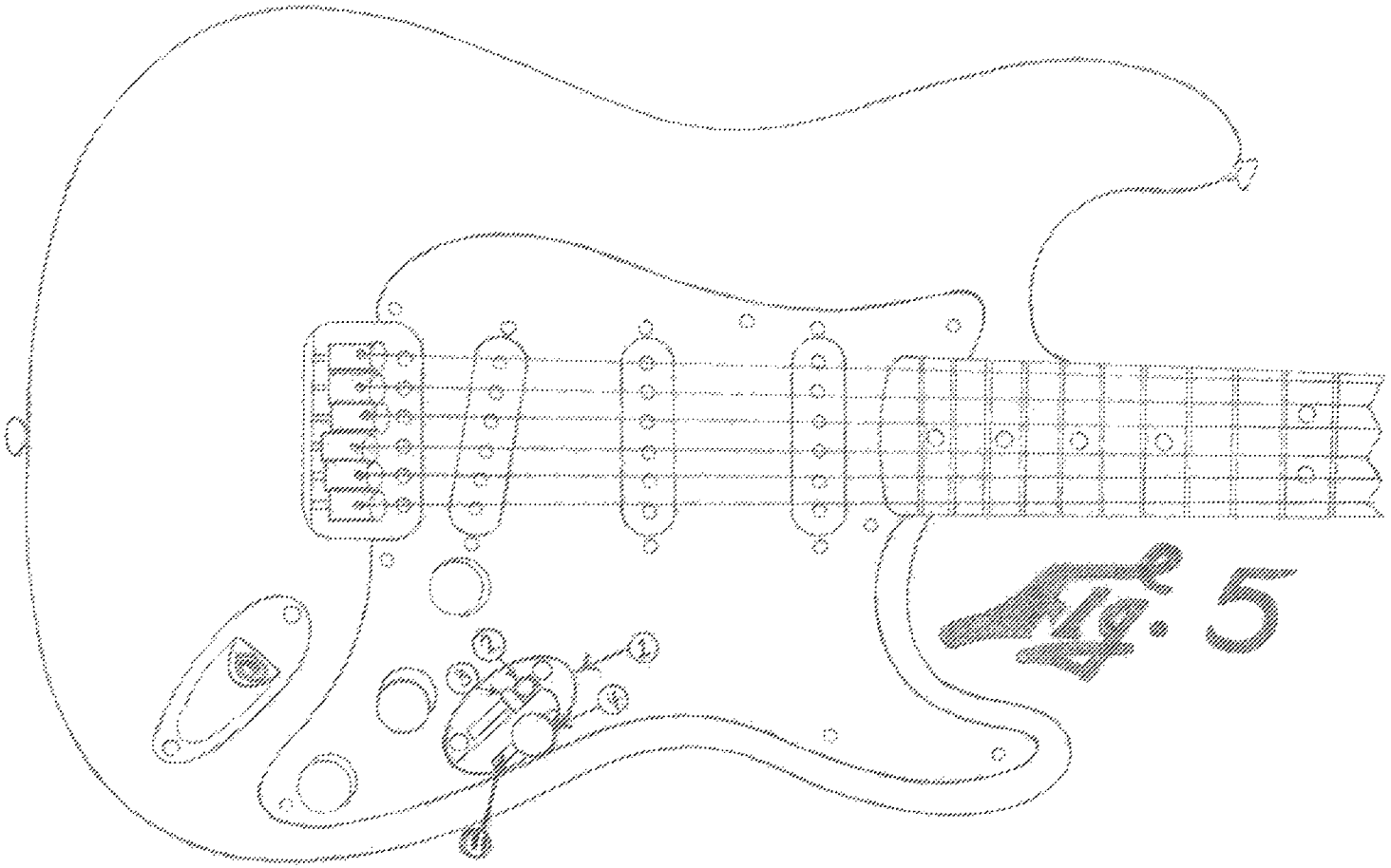
FIG. 5 is a view of a guitar having a selector switch position lock apparatus installed in congruence with present disclosure.
Figure 6:
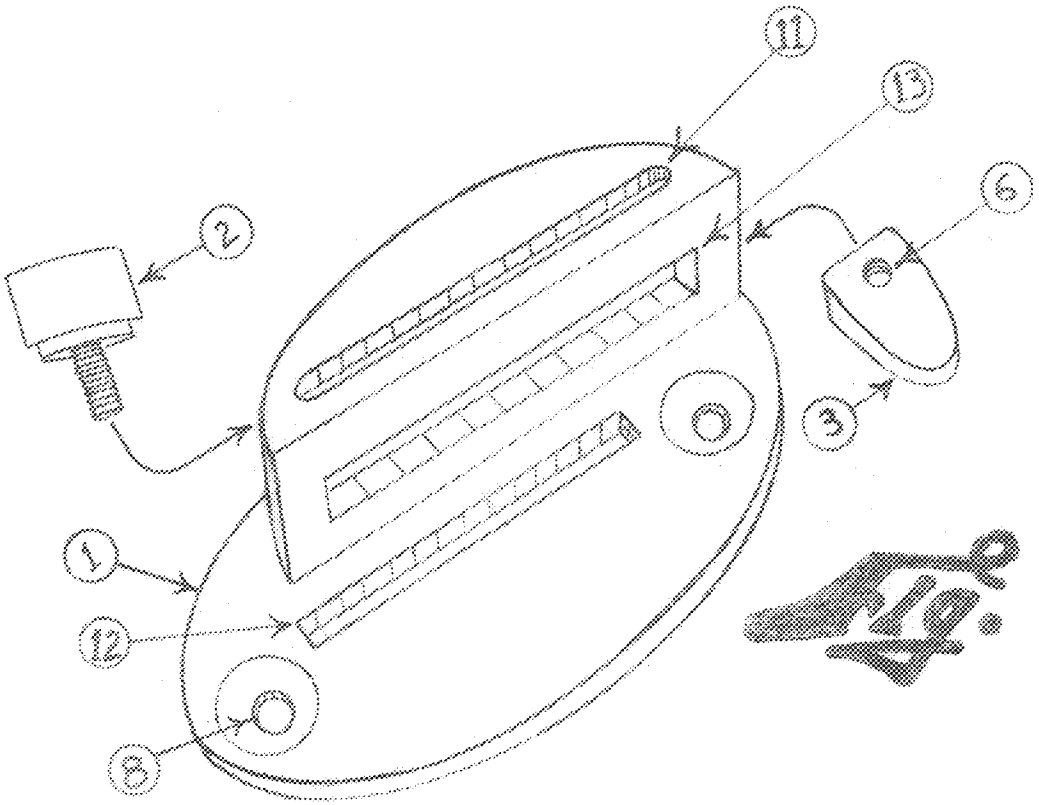
FIG. 6 is an enlarged view of a selector switch position lock apparatus depicted in FIG. 5.
Figure 7:
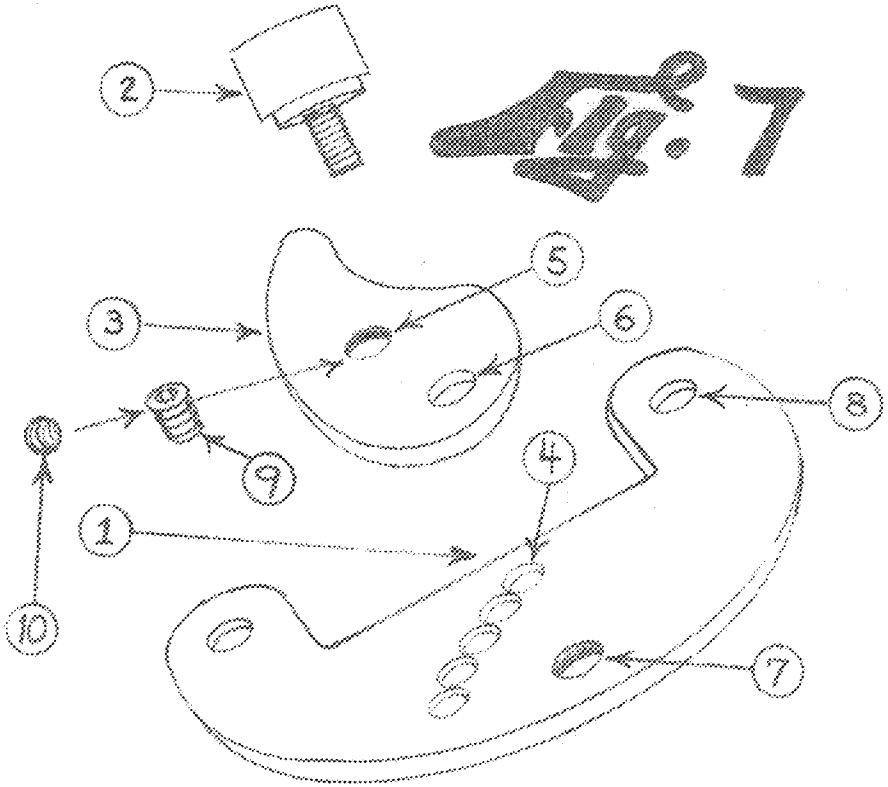
FIG. 7 is an enlarged view of a selector switch position lock apparatus depicted in FIG. 3 containing additional features.
Figure 8:
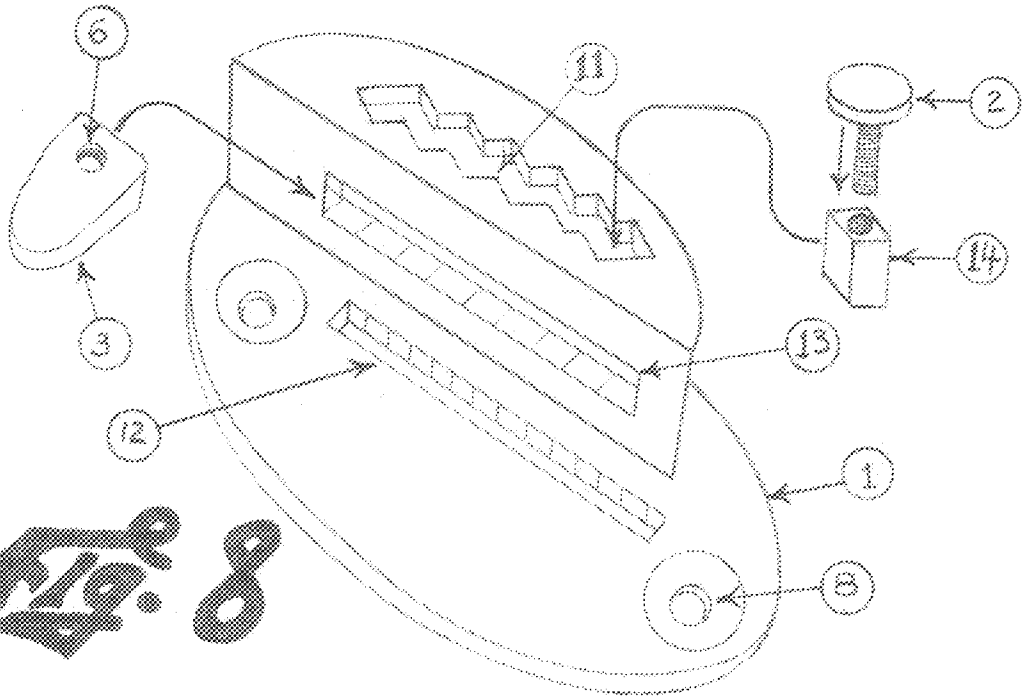

The invention claimed is:

1. A switch control apparatus for electric guitar having multiple electromagnetic pickups and a pickup selector switch for triggering the pickups, individually or in combination, which sends their signal to an amplifier, the switch control apparatus comprised of: a thumb screw securing knob, swing arm retaining plate, and base late; the base plate is characterize by two mounting holes for mounting to guitar face that correspond with mounting holes of the said pickup selector switch, a threaded hole for thumb screw securing knob, position divots located on a top surface of the base plate, in conjunction with a thumb screw securing knob, are configured to locate and secure swing arm retaining plate positions that coincide with pickup selector switch positions; the swing arm retaining plate characterized by a through hole for thumb screw securing knob and a set screw for the location of positon divots on a top surface of base plate; the thumb screw securing knob is characterize by a threaded shaft for insertion into base plate and a knurled knob.

2. The switch control apparatus of claim 1, wherein: the swing arm retaining plate can be secured by the thumb screw securing knob in coordination with any of the pickup selector switch positon.

3. The switch control apparatus of claim 1, wherein: the swing arm retaining late is configured to reduce the mechanical path of travel available in the pickup selector switch.

4. The switch control apparatus of claim 1, wherein: the swing arm retaining plate is configured to reduce the pickup selections available in the pickup selector switch.

5. The switch control apparatus of claim 1, wherein: the pickup selector switch path of travel is shortened by the swing arm retaining plate's position when secured by the thumb screw securing knob.

6. The switch control apparatus of claim 1 eliminates access to the pickup selector switch positions determined by the position divots.

* * * * *